United States Patent [19]

Tabourier

[11] 4,100,545

[45] Jul. 11, 1978

[54] MISSILE GUIDANCE SYSTEM

[75] Inventor: Rémy Tabourier, Paris, France

[73] Assignee: Thomson-CSF, Paris, France

[21] Appl. No.: 725,495

[22] Filed: Sep. 22, 1976

[30] Foreign Application Priority Data

Sep. 24, 1975 [FR] France ..... 75 29266

[51] Int. Cl.[2] ..... G01S 9/02; F41G 7/00

[52] U.S. Cl. ..... 343/7 ED; 343/7 A

[58] Field of Search ..... 343/7 A, 7 ED

[56] References Cited

U.S. PATENT DOCUMENTS

| | | | |
|---|---|---|---|
| 3,137,850 | 6/1964 | Alpers | 343/7 A X |
| 3,212,083 | 10/1965 | Hinchman | 343/7 A X |
| 3,394,371 | 7/1968 | Mahler | 343/7 A X |
| 3,938,148 | 2/1976 | Hobson | 343/7 A |

*Primary Examiner*—T.H. Tubbesing

*Attorney, Agent, or Firm*—Karl F. Ross

[57] ABSTRACT

The invention relates to missile-guidance systems of the semi-active homing type using the Doppler effect, designed for air-to-air, ground-to-air or ship-to-air installations. On the radar installation, a first illuminator comprising a directional antenna illuminates a target with a wave of first frequency $F_1$. The wave reflected by the target is picked up by an antenna situated at the front of the missile. A second illuminator comprising a wide-beam antenna illuminates an antenna situated at the rear of the missile with a continuous wave of second frequency $F_2$ coherent with the wave of frequency $F_1$. The local oscillator in the receiver of the missile is phase-controlled in dependence upon the continuous wave of frequency $F_2$.

6 Claims, 3 Drawing Figures

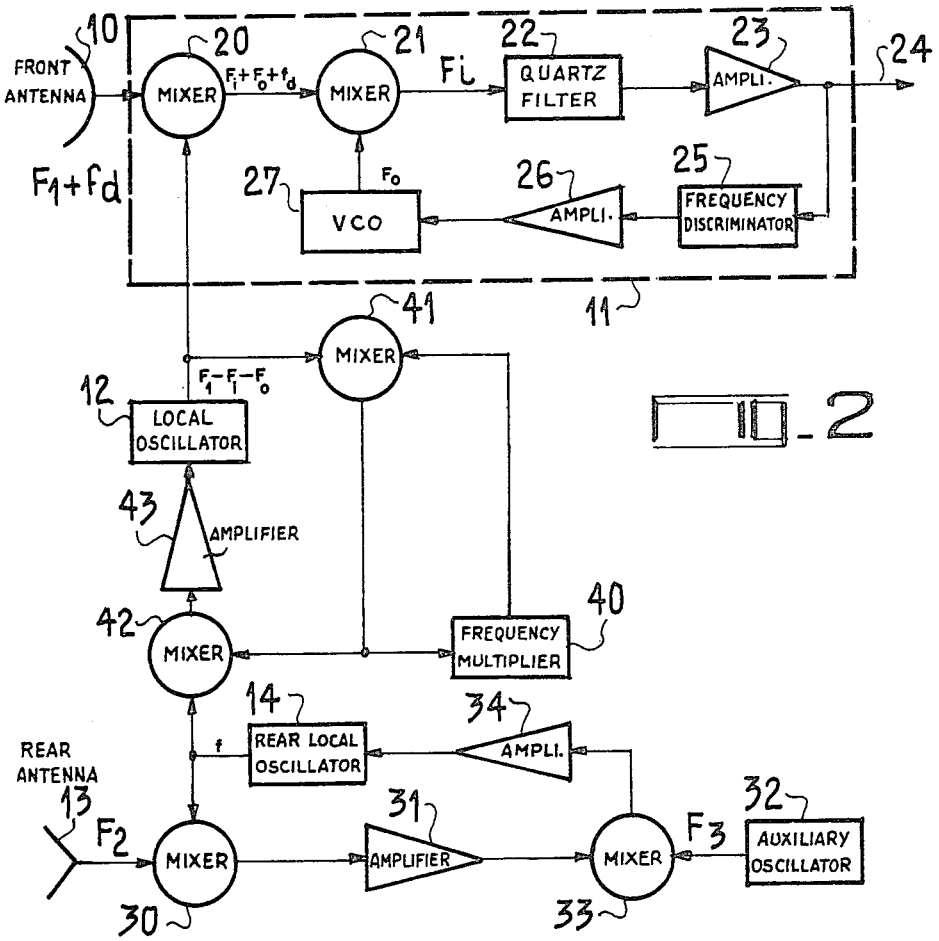
FIG. 2
FIG. 3
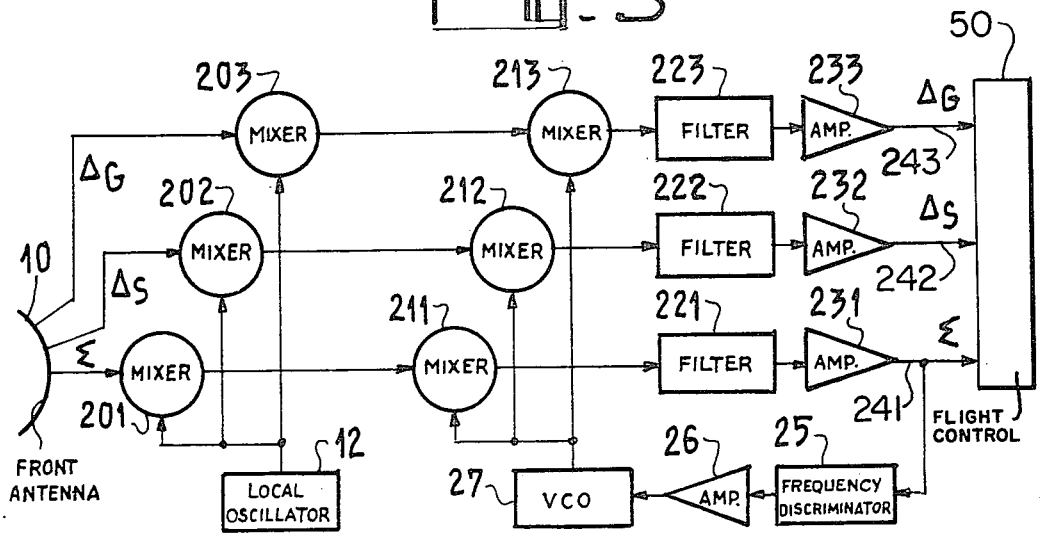

MISSILE GUIDANCE SYSTEM

FIELD OF THE INVENTION

My present invention relates to missile-guidance systems and, more particularly, to systems of the semi-active homing type using the Doppler effect and designed for air-to-air, ground-to-air or ship-to-air installations.

BACKGROUND OF THE INVENTION

Systems of this kind, designed to strike a target by means of a missile provided with a front antenna and a rear antenna, comprise an illuminator separated from the missile which simultaneously illuminates the target and the missile. The illuminator is associated with a tracking radar.

The illumination-wave signal reflected by the target is received by the front antenna of the missile and is detected coherently with the wave directly received by the rear antenna. The spectrum of the resulting signal contains the target echo at a frequency substantially proportional to its relative velocity. The Frequency-tracking means are then used to lock the receiver onto the target echo and to extract the data required for the automatic guidance of the missile.

Unfortunately, these systems are attended by considerable limitations which arise out of the need to use a rear channel on board the missile.

This is because the useful echo picked up by the receiver at the front of the missile may be masked by the illumination wave directly received by the side lobes of the front antenna. Although these two signals are not at the same frequency (the useful echo is affected by a frequency shift proportional to the velocity of the target relative to the missile), the parasitic echo received by the side lobes, affected by phase noise attributable to the illuminator and to the local oscillator of the receiver, may have a significant level at the Doppler frequency of the useful echo. In addition, this noise unnecessarily extends the spectrum received from ground echoes.

The conventional solution, in which the phase of the local oscillator of the receiver is controlled in dependence upon the illumination wave received by the rear antenna, makes it possible to obtain compression of the noise inherent in the local oscillator which, in addition, recopies the noise inherent in the illuminator.

In order to illuminate the rear channel in a sufficient volume of space, it is standard practice to feed a wide-beam ancillary antenna with a fraction of the power of the illuminator.

If the illuminator of the weapon system is independent of the radar, it is possible to couple the two transmitters with the same principal directional antenna while the illuminator alone feeds the ancillary antenna. Unfortunately, this solution is relatively complicated and inconvenient to use.

If it is the actual radar wave which simultaneously ensures illumination, the ancillary antenna is of necessity connected to the transmitter of the radar. It then impairs the performance of the principal antenna and, accordingly, the low-altitude performance of the radar by increasing the level of parasitic echoes attributable to the presence of the ground.

In a system where the tracking radar is a pulsed Doppler radar which is also used as illuminator for a pulsed Doppler autodirector, the problem is twofold:

it is no longer possible to decouple the ancillary antenna from the radar transmitter whose low-altitude performance is definitely impaired;

sampling of the signal received at the rear of the missile at the repetition frequency of the radar limits the bandwidth of the phase control of the local oscillator of the receiver and thus limits its effectiveness.

OBJECTS OF THE INVENTION

One of the objects of the present invention is to provide a solution which is not subjected to any of the above disadvantages and limitations.

Another object of the invention is to provide a system which retains the advantages of continuous-wave autodirectors.

Yet another object of the invention is to minimizes overloading and congestion in the radar station which is of particular advantage in the case of an airborne radar station.

SUMMARY OF THE INVENTION

The illuminating radar of my improved missile-guidance system includes a pilot oscillator, a first illuminating transmitter coupled to a first antenna and to the pilot oscillator through a first frequency-multiplying circuit to produce a target-illuminating signal at a first frequency $F_1$ and a second illuminating transmitter coupled to a second antenna and to the pilot oscillator through a second frequency-multiplying circuit to produce a rear reference continuous-wave signal for the missile at a frequency $F_2$ different from $F_1$. A receiver aboard the missile coupled to the front antenna is connected a front local oscillator whose frequency and phase are controlled, via a frequency multiplier, by a rear local oscillator which is turn is phase-controlled by the continuous wave received by the rear antenna. The missile is directed toward its target by conventional flight-control means responsive to the output signals of the receiver.

Accordingly, the system according to the invention requires an additional antenna at the radar station. However, this antenna is already present on board most military aircraft. The antenna in question is the antenna of the secondary radar which is used for identifying targets. This antenna, of wide beam, is mechanically integral with that of the principal radar. It is thus pointed in the same direction and, according to the invention, transmits a continuous wave coherent with the radar wave, i.e., generated from the same pilot oscillator, but of different frequency.

The rear channel and the front channel of the missile thus operate in different frequency bands. By virtue of the fact that the wave received by the rear antenna is continuous, the local oscillator of the receiver may be phase-controlled within a wide band in dependence upon the illumination wave.

This solution has numerous advantages.

It enables the principal radar to be used as an illuminator without requiring its characteristics to be changed when the missile is fired, as long as the waves transmitted by it remain coherent with those of the illuminator for the rear antenna of the missile. A wide variety of characteristics of the illumination signal may thus be utilized.

It retains the advantages of continuous-wave guidance systems in regard to their ability to reject the signal received by the side lobes of the front antenna and to compress the noise inherent in the local oscillator, even if the target is illuminated by pulses.

It has the advantage over the conventional solution of enabling a carrier frequency substantially incapable of attenuation by the flame of the missile-propulsion system to be selected for the illumination wave of the rear channel. This particular advantage is not specific to air-to-air systems. A system such as this may also simplify a study of the propulsion of a missile fired from the ground.

Finally, the existence of a rear channel of the type in question enables it to be used if desired as a remote-control channel.

BRIEF DESCRIPTION OF THE DRAWING

Other features and advantages of the invention will become apparent from the following description given in conjunction with the accompanying drawing, wherein:

FIGS. 2 and 3 illustrate an embodiment of the receiving means on board the missile.

SPECIFIC DESCRIPTION

Figure 1:
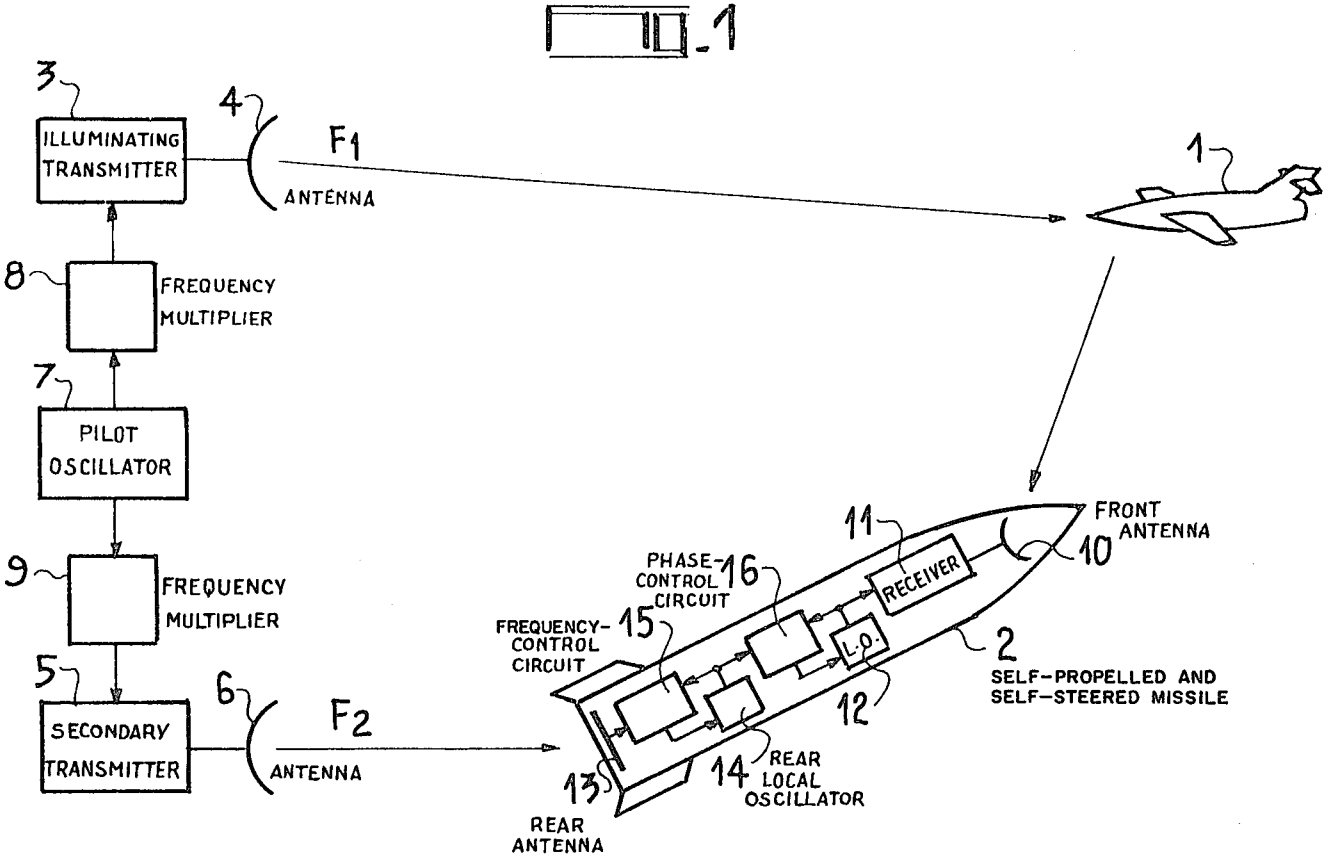
FIG. 1 is a diagram illustrating the principle of a missile guidance system according to the invention.

Figure 1 shows the missile-guidance system as a whole.

A missile 2 comprising conventional and nonillustrated self-propulsion and self-steering means heads towards a target 1 (for example an aircraft). The missile is guided by a radar station which comprises: a main transmitter 3 illuminating the target 1 with a wave of frequency $F_1$ by way of a directional antenna 4; a secondary transmitter 5 transmitting a continuous wave with a frequency $F_2$ towards the rear of the missile by way of a wide-beam antenna 6 which is mechanically coupled with the antenna 4; and a pilot oscillator 7 coupled with the illuminator 3 and with the secondary transmitter 5 by means of two frequency-multiplication circuits 8 and 9, respectively, which ensure the coherence of the transmitted waves of frequencies $F_1$ and $F_2$. The illuminator 3 may be a continuous-wave or pulsed tracking radar. It is directed towards the target. The energy reflected by the target at the frequency $F_1$ is received at the front of the missile by a front antenna 10 coupled with a receiver 11. The antenna 10 and the receiver 11 serve to determine the direction of the target and to enable the missile to be direction-controlled so that it heads towards the target. The receiver 11 is associated with a local oscillator 12 phase-controlled in dependence upon the wave of frequency $F_2$ received by a rear antenna 13.

The oscillator 12 is phase-controlled by means of a rear local oscillator 14 whose operating frequency and phase are controll by a frequency control circuit 15 coupled with the antenna 13 and a phase-controll circuit 16 in which there is a coherent frequency change from $F_2$ to $F_1$. This phase control compresses the noise inherent in the local oscillator 12 and enables same to recopy the noise of the illuminator 3 which is in fact the noise of the pilot oscillator 7. This phase control has a large bandwidth by virtue of the fact that the waves received at the rear are continuous waves.

The use of a pilot oscillator 7 common to the illuminator 3 and to the secondary transmitter 5 does not involve any practical problems. The ratio of the frequencies $F_2$ and $F_1$ determined by the multiplication factors of the circuits 8 and 9 has to be reproduced in the control circuit 16 on board the missile.

FIG. 2 shows a preferred embodiment of the receiving circuits on board the missile. In the interests of simplicity, it has been assumed that the antenna 10 has only one receiving channel. FIG. 3 then shows the three receiving channels which are necessary for extracting the angular data relating to the target and, hence, for guiding the missile towards it.

In the receiver 11 (FIG. 2), the front antenna 10 is connected to a first mixer 20 which also receives the output signal of the front local oscillator 12. A second mixer 21 is connected to the outputs of the mixer 20 and of a controllable-frequency oscillator 27 (VCO) of basic operating frequency $F_o$. The mixer 21 is followed by a quartz filter 22 with a narrow band centered onto an intermediate frequency $F_i$ and then by an amplifier 23 which delivers the output signals of the receiver at intermediate frequency to a lead 24. A frequency discriminator 25 centered on the intermediate frequency $F_i$ is connected to the output of the amplifier 23 and controls the frequency of the oscillator 27 by way of a loop amplifier 26.

The rear antenna 13 which receives the continuous waves at the frequency $F_2$ is connected to a mixer 30 which is also connected to the rear local oscillator 14. An auxiliary oscillator 32 operating at low frequency, thereby producing only negligible noise, is connected to a mixer 33 which also receives the output signal of the mixer 30 amplified at 31. The output of the mixer 33, operating as a phase detector, controls the frequency of the local oscillator 14 by way of a loop amplifier 34.

The rear local oscillator 14, phase-controlled in dependence upon the rear wave, controls the phase of the front local oscillator 12 which generates a wave at a different frequency (higher in the example described). A mixer or phase detector 42 receives on the one hand the signal produced by the rear local oscillator 14 and on the other hand the output signal of a mixer 41. The mixer 41 is also connected to a circuit 40 for frequency multiplication by a factor $n$ and receives on the one hand the output signal of the front local oscillator 12 and on the other hand the output signal of the multiplier 40. The output of the detector 42 controls the frequency of the oscillator 12 by way of a loop amplifier 43.

The receiver operates as follows: there are three separate sections to be separately considered, i.e., the section for receiving the target signals which comprises a frequency-tracking loop, the phase control of the rear local oscillator, and the phase control of the front local oscillator coupled with the receiver.

The waves received by the front antenna 10 have a Doppler frequency $f_d$ due to the relative movement of the missile and the target. The received frequency is $F_1 + f_d$. The operating frequency of the front local oscillator 12 is $F_1$ $F_i$ $F_o$. At the output of the mixer 20, the signals received are converted to the frequency $F_i + F_o + f_d$. At the output of the mixer 21, also receiving a frequency close to $F_o$ from oscillator 27, the incoming signals are close to the frequency $F_i$. The discriminator 25 in the frequency-tracking loop detects the frequency deviations in the incoming signals from the central frequency $F_i$. Any deviation is reflected in a corresponding shift in the frequency of the oscillator 27. A target, characterized by a frequency $f_d$, will thus be kept under surveillance by the received signal, even if this frequency $f_d$ varies as a result of variations in the velocity of the missile or target. Acquisition of the target echo may be carried out before the missile is launched by scanning the frequency of the oscillator 27 by means of an adjoining control circuit which has not been shown. The operating frequency $f$ of the rear local oscillator 14 is controlled by comparison, in the phase detector 33, of the wave produced by the oscillator 32 of frequency $F_2 - f = F_3$ with the output of mixer 30 connected to 13 and oscillator 14.

The frequency-control loop of the front local oscillator 12 comprises the multiplier 40 of multiplication factor working into mixer 42. The frequency of the front local oscillator is thus equal to $(n+1)f$ or $(n-1)f$.

The phase controls described above enable the local oscillator 12 to recopy the noise of the pilot oscillator 7 common to the illuminator 3 and to the secondary transmitter 5.

Figure 3 shows the front antenna 10 delivering three standard signals $\epsilon$, $\Delta S$ and $\Delta G$ enabling the direction of the target to be determined. Only the receiving channel for the signal $\epsilon$ includes the frequency-control loop 25–27 shown in FIG. 2. The three receiving channels respectively comprise input mixers 201, 202 and 203 connected together to the front local oscillator 12, followed by mixers 211, 212 and 213 connected together to the oscillator 27 of the frequency-control loop. They are followed by quartz filters 221, 222 and 223 and then by amplifiers 231, 232 and 233 which deliver the acquisition and angular-deviation signals $\epsilon$, $\Delta S$ and $\Delta G$ at intermediate frequency, on respective output leads 241, 242, 243, to a conventional flight-control circuit 50 which derives therefrom the angular data required for directing the missile onto its target.

The main advantage of the invention is that it enables a radar to be used for illuminating the target, the radar being controlled by the pilot oscillator 7, while at the same time retaining the advantages of the continuous-wave missiles. By virtue of the successive phase controls between the rear antenna 13 and the front local oscillator 12, the latter oscillates in coherence with the waves transmitted by the illuminator 3, even if the illuminator only transmits pulses.

The secondary transmitter 5 illuminating the rear antenna of the missile may advantageously be the transmitter of the identification system. It has been found that the rear wave transmitted on certain frequencies, even low frequencies (band L for example), was occasionally less attenuated by the flame of the missile-propulsion system than the illumination wave whose carrier has a band X or K*u*.

Of course the invention is not limited to the embodiment described and shown which is given solely by way of example.

I claim:

1. In a guidance system for a self-propelled and self-steered missile provided with a rear antenna and a front antenna, in combination:

a radar station including a pilot oscillator, a first illuminating transmitter coupled to a first antenna and to said pilot oscillator through a first frequency-multiplying circuit to produce a target-illuminating signal at a first frequency $F_1$, and a second illuminating transmitter coupled to a second antenna and to said pilot oscillator through a second frequency-multiplying circuit to produce a rear reference continuous-wave signal for the missile at a frequency $F_2$ different from $F_1$;

a receiver aboard said missile coupled to said front antenna, a front local oscillator connected to said receiver, a rear local oscillator phase-controlled by the continuous wave received by the rear antenna, and phase-control means comprising a frequency multiplier for controlling the frequency and the phase of said front local oscillator by said rear local oscillator; and flight-control means aboard said missile connected to said receiver for directing the missile toward the target.

2. The combination defined in claim 1 wherein said receiver comprises at least one receiving channel which includes a first mixer coupled with the front antenna on the one hand and with the front local oscillator on the other hand, a second mixer coupled with the first mixer on the one hand and with a controllable-frequency oscillator on the other hand, a narrow-band filter followed by an amplifier connected to the output of the second mixer, and a frequency discriminator centered onto the same frequency as said narrow-band filter connected in series with an amplifier between the output of said amplifier and a frequency-control input of said controllable-frequency oscillator, said amplifier having an output connected to said flight-control means.

3. The combination defined in claim 2 wherein said receiver further comprises two other receiving channels for angular-deviation signals, each receiving channel comprising in series a first mixer coupled on the one hand with said front antenna and on the other hand with the front local oscillator, a second mixer receiving the signal of the controllable-frequency oscillator, a narrow-band filter, and an amplifier.

4. The combination defined in claim 1 wherein said phase-control means comprises a first mixer for receiving the signals produced on the one hand by said front local oscillator and on the other hand by said frequency multiplier and connected at its output to the input of said frequency multiplier, a second mixer receiving the signals produced on the one hand by the first mixer and on the other hand by the rear local oscillator, and a loop amplifier connected between the second mixer and a frequency-control input of the front local oscillator.

5. In a guidance system for a self-propelled and self-steered missile provided with a rear antenna and a front antenna, in combination:

a radar station comprising a pilot oscillator, a first illuminating transmitter coupled to a directional antenna pointed toward a target and to said pilot oscillator through a first frequency-multiplying circuit to produce a target-illuminating signal at a first frequency $F_1$, and a second illuminating transmitter coupled to a wide-beam antenna mechanically integral with the directional antenna and pointed in the same direction and to said pilot oscillator through a second frequency-multiplying circuit to produce a rear reference continuous-wave signal for the missile at a frequency $F_2$ different from $F_1$;

a receiver aboard said missile coupled to said front antenna, a front local oscillator connected to said receiver, a rear local oscillator phase-controlled by the continuous wave received by the rear antenna, and phase-control means comprising a frequency multiplier for controlling the frequency and the phase of said front local oscillator by said rear local oscillator; and flight-control means aboard said missile connected to said receiver for directing the missile toward the target.

6. The combination defined in claim 5 wherein said first illuminating transmitter is the transmitter of a tracking radar and the second illuminating transmitter is a target-identification transmitter.

* * * * *